United States Patent [19]

Spedding

[11] 4,250,735

[45] Feb. 17, 1981

[54] PRESS ACTION MACHINES

[75] Inventor: Ian M. Spedding, Lytham, England

[73] Assignee: Hawkhead Bray & Son Limited, Halifax, England

[21] Appl. No.: 924,591

[22] Filed: Jul. 14, 1978

[30] Foreign Application Priority Data

May 30, 1978 [GB] United Kingdom ..... 24636/78

[51] Int. Cl.[3] ..... B21J 13/04

[52] U.S. Cl. ..... 72/455; 72/402; 72/453.01; 100/214; 100/269 R

[58] Field of Search ..... 72/455, 453.01, 453.18, 72/402, 407, 456; 100/214, 269 R

[56] References Cited

U.S. PATENT DOCUMENTS

| | | | |
|---|---|---|---|
| 2,429,780 | 10/1947 | Terhune | 72/453.01 |
| 2,600,164 | 6/1952 | Heywood | 100/269 R |
| 2,859,793 | 11/1958 | Ross | 72/453.18 |
| 3,064,558 | 11/1962 | Von Platen | 100/214 |
| 3,451,249 | 6/1969 | Sharon | 72/453.18 |
| 3,568,495 | 3/1971 | Duffield | 72/453.01 |
| 3,570,301 | 3/1971 | Perner | 100/269 |
| 3,717,024 | 2/1973 | Davison | 100/214 |
| 3,805,584 | 4/1974 | Nilsson | 100/214 |
| 3,931,728 | 1/1976 | Trolle | 100/214 |
| 3,969,921 | 7/1976 | Jonsson | 100/214 |
| 4,008,659 | 2/1977 | Trolle | 100/214 |

FOREIGN PATENT DOCUMENTS

| | | | |
|---|---|---|---|
| 298487 | 6/1971 | U.S.S.R. | 100/214 |

*Primary Examiner*—Francis S. Husar
*Assistant Examiner*—Gene P. Crosby
*Attorney, Agent, or Firm*—John C. Smith, Jr.

[57] ABSTRACT

The invention provides a press action machine having a body which supports an operative element and means mounting the operative element for simple linear reciprocatory movement, the body itself being in the form of a curvilinear loop such as a circle or ellipse, and the arrangement of the operative element being such that the direction of its linear reciprocatory motion is parallel with a diameter of the body.

Since there may be more than one operative element, the arrangement is preferably such that the reaction to the vector addition of the operative forces is substantially on a diameter of the body.

Arrangements are described in which there are reinforcing struts arranged chordally of the body loop and in one arrangement, the body comprises a plurality of concentric loops. In another arrangement, the body comprises a series of loops secured together end-to-end.

12 Claims, 7 Drawing Figures

PRESS ACTION MACHINES

The present invention is concerned with press action machines, that is to say, machines in which there is provision for simple linear reciprocatory motion of at least one operative element such for example, as a ram or a ram and a base or two or more rams. All such machines will be hereinafter referred to as "press action machines".

Typical of the press action machine is the conventional machine press, in which two parts of a press tool are usually supported respectively on a platen and movable member which is adapted to be projected towards the platen, to cause the tool to perform an operation on a workpiece positioned between the platen and the movable member. Machine presses of this kind are sometimes fitted with a press tool die set, which essentially comprises a base having upstanding pillars, and a movable part mounted on the pillars, for movement towards and away from the base. If a press tool die set is employed, it is placed on the platen of the press, and the movable part is aligned with the movable member of the press. Thus, the platen and the movable member constitute the pair of operative elements between which there is relative linear reciprocatory motion.

Another typical press action machine, is a die casting machine, in which the fixed block of the die is carried on a support such as a platen, and the moving block is carried by a member movable towards and away from the platen. Again, therefore, there is the basic relative linear reciprocatory motion between the movable member and the platen, controlling the opening and closing of the die. Other examples of machines which fall within the definition of "press action machines" and which consequently are within the scope of the invention are:- drill presses; screwdriving presses; nailing presses; glueing presses or jigs; laminating presses; vacuum forming machines; the heating apparatus of vacuum forming machines; blow-moulding machines and concrete presses.

The expression "press action machine" is also intended to comprehend simple clamping action devices, which are adapted to hold workpieces in a fixed position.

According to this invention, a press action machine has a body which supports an operative element having a simple linear reciprocatory stroke, the body being in the form of a circular or elliptical loop and the arrangement of the operative element being such that the direction of the linear reciprocatory motion is parallel with a diameter of the body. Preferably, the parts are so arranged that the reaction to the operative force, or to the vector addition of the operative forces is substantially on a diameter of the body. The reaction may pass through the operative elements.

The conventional fly press has a body which comprises a base supporting an anvil, an upright column and a head mounting the tool carrier, the body being generally of C-shape with the head overhanging the base, so that the workpiece can be inserted and removed through the open side of the C. The reaction to the operative forces applied in the fly press produces bending stresses in the column of the C-shaped body, and for this reason, the body has to be a relatively massive structure.

There are however conventional presses comprising a pair of ends, with two or more struts extending between the ends, and in these machines, one does not set up bending stresses due to overhanging loads as in the C-shaped fly press. In fact, the reaction to the operative force simply sets up tension in the struts connecting the ends of the machine body.

The essential characteristic of the present invention is the use of a body which is in the form of a circular or elliptical loop, and as a result of this construction, the reaction to operative force simply attempts to elongate the loop (that is to extend a first diameter of the loop parallel with the line of action of the operative force, and to contract the diameter of the loop at right angles to the line of action of the operative force). Thus, the stresses applied to the body when the machine is carrying out an operation are hoop stresses, and these place lower strains on the body than is the case with the bending stresses normally set up in the column of a C-shaped body, or the tensile stresses normally set up in the struts of a column-type press. Consequently, the body can have a smaller cross-sectional shape than would be required for the body of a conventional machine adapted to carry out the equivalent operation. Furthermore, the machine body is easier and cheaper to construct than conventional press action machine bodies, and this is particularly the case, if the loop of the body is circular.

There may be one or more reinforcing struts for the body, each arranged chordally of the body loop, and the body may be made of rolled metal section. In the preferred construction, the body simply comprises a length of rolled steel section bent into the form of a ring or ellipse, with its ends welded together so as to form a complete loop. It will be appreciated, that this is both a simple and cheap method of producing a machine body. Obviously, it is necessary to provide feet or some other support structure on the outside of the loop body, so that the body can be stood upright without any tendency to roll, but the main stresses set up during operation of the machine tool are carried largely by the hoop formed by the body.

In one arrangement the body comprises two or more concentric loops as a means of providing a stronger reaction to the operative forces than would be provided by a single loop. Other reinforcing methods such as wire-winding may also be employed.

According to another preferred feature of the invention, the machine body comprises two or more complete loops, secured together end-to-end. In this wy, it is possible to form a body having a thickness, measured from front to rear, greater than that of the thickness of a single loop body. The loops may be secured together in face-to-face relationship, so that the overall thickness is simply the summation of the thickness of the loops, or the loops may be secured together by a spacing structure, so that the overall thickness is greater than the summation of the thicknesses of the individual loops.

In one form, the invention comprises a press tool having a circular or elliptical loop body, an anvil carried by a support beam extending across the chord of the body and secured to the body, and a tool carrier mounted for reciprocation along a diameter of the body perpendicular to the said chord, there being power means for reciprocating the tool carrier, said power means being also supported by the body. The power means may comprise manually operable means, or means adapted to be operated by electrical hydraulic or pneumatic apparatus, and in a preferred arrangement, it comprises a pneumatic or hydraulic ram or rams. Such a ram may be supported on the body, for example, on a beam secured to the body and extending across a chord of the body, or it may be pivotally mounted on a trunnion. There may also be mechanism for increasing the mechanical advantage between the power source and the movable part, such as a screw-and-nut, a toggle or a crank mechanism.

The invention will be better understood, from the following description of certain machines, which are described here by way of example only, with reference to the accompanying drawings, in which:-

Figure 2:
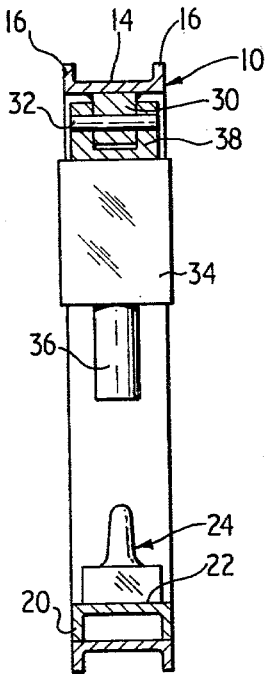
FIG. 2 is a section on the line II—II in FIG. 1.
Figure 1:
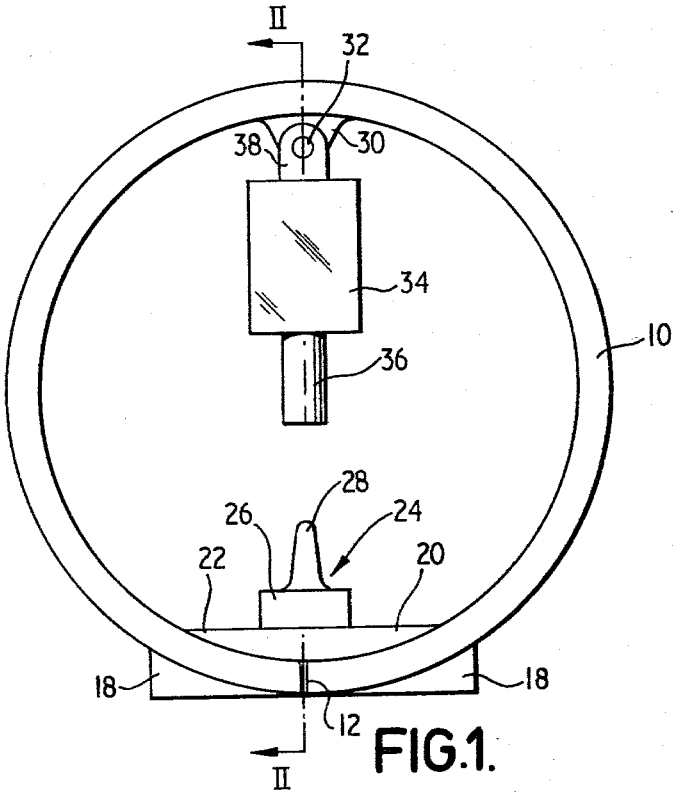
FIG. 1 is an end view of a simple form of press action machine.

The machine illustrated in FIGS. 1 and 2 has been designed to carry out simple pressing operations on metal components, such as components made in sheet materials. Pressing operations of this kind, are frequently carried out on a fly press, but the machine which is illustrated would be lighter in construction than a fly press required to carry out a similar operation.

The press has a circular body 10, which is made from a length of channel-shaped rolled steel (see FIG. 2) bent into the form of a circle, with its ends welded together at 12. In this particular construction, the channel section is arranged with its web 14 on the inside of the circular hoop, and the flanges 16 projecting outwardly therefrom. Two steel blocks 18 are welded to the outside of the circular body 10, and are so positioned, that they provide effective feet, so that the body 10 can stand in an upright position without rolling. It will be appreciated, that the blocks 18 could extend forwardly and rearwardly of the hoop 10, and be formed with holes to receive fixing bolts, whereby the machine tool can be secured to a foundation or to a bench. In fact, any kind of mounting arrangement can be used, and whilst in the example which is being described, it is convenient for the body 10 to stand in an upright position, it is to be understood, that in some instances it could be otherwise orientated, for example, the hoop could lie in a horizontal or inclined position. Further, the body could be mounted for tilting about an axis—a feature which could be useful for example, in gravity die-casting.

A short channel-shaped member 20 is fitted into the bottom portion of the body 10, so that its top surface 22 is horizontal, and this member 20 is welded to the body 10, so that it forms an integral part of the body, providing in effect a platen, which can be considered as one of the operative elements of the machine.

A die 24 can be placed on the horizontal surface 22 of the platen 20, and this die may be of any shape as required by the forming operation which is to be carried out on the press. In FIGS. 1 and 2, there is illustrated a die which simply comprises a base block 26, having an upstanding spigot 28. It is to be understood however, that this die is illustrated by way of example only, and that dies of any shape could be used on the press as required.

At the zenith of the hoop body 10, a substantial lug 30 is welded to the inside of the body, and provides a mounting for a trunnion peg 32. An hydraulic cylinder 34, having a ram 36 is formed with a clevis 38, whereby it can be suspended on the trunnion peg 32. In the freely suspended position which is illustrated in the drawings, the ram 36 extends vertically, and is axially aligned with the die 24, the vertical line of action of the ram 36 being coincident with the vertical axis of the body 10.

When the press illustrated in FIGS. 1 and 2 is to be operated, a workpiece is placed on the die 24, and a complementary die (not shown) is fastened on the ram 36. The hydraulic cylinder 34 is then operated by controls which have not been illustrated in order to simplify the drawings, and this causes the ram 36 to project its die towards and into contact with the workpiece on the die 24. The machine carries out a conventional pressing operation on the workpiece, and at the end of its working stroke, the cylinder 34 is reversed, to withdraw the die carried by the ram 36 from engagement with the workpiece. The workpiece can then be removed from the press.

It will be appreciated, that the operation of the press is entirely conventional, and the only limitation which the construction of the press places on the operation is that the width of the workpiece must not be greater than the distance between opposite sides of the hoop body 10, at the position where the workpiece is inserted. In practice, this is unlikely to be a serious limitation, and in any case, a similar limitation occurs with the known column-type machine.

Figure 4:
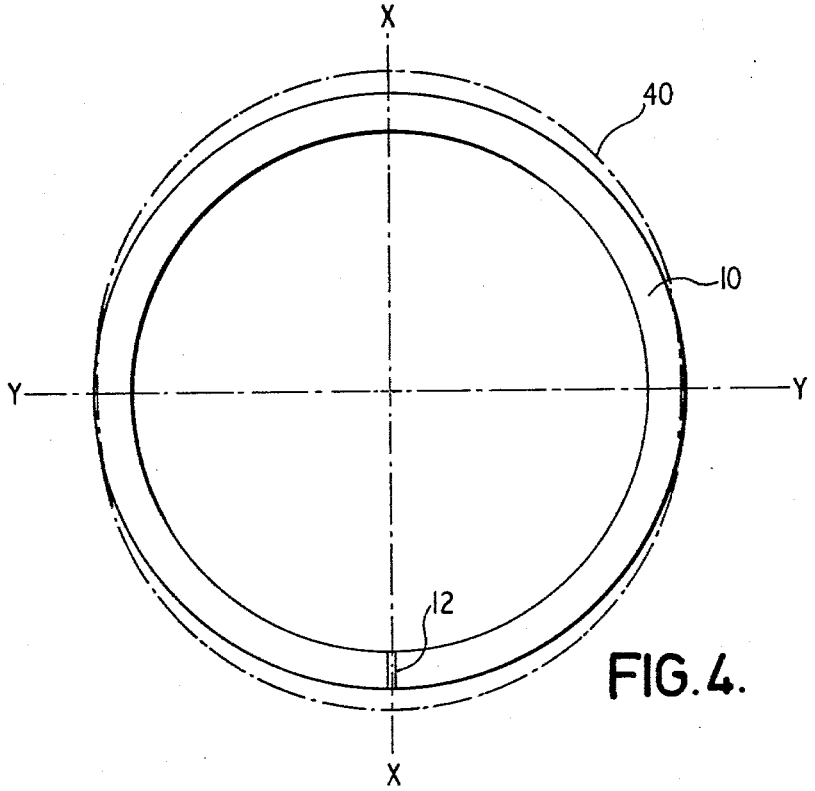
FIG. 4 is a diagram illustrating the stressing of a machine body.

However, it is to be noted, that during the operative stroke, the reaction to the working force acts diametrically outwardly, along the line X—X (see FIG. 4). In other words, the reaction force tends to deform the circular body 10, into an elliptical body as indicated by the chain-dotted line 40 in FIG. 4, the major axis of the ellipse being aligned with the line of action of the press, and the minor axis Y—Y extending at right angles thereto. Any extension along the X—X axis, will produce a corresponding reduction along the Y—Y axis. Distortion of the machine body by extension of the X—X axis is acceptable, because this distortion is evenly distributed around the body, and hence will have no deleterious effect on the pressing action. Moreover, it will be appreciated that the stress set up in the body 10, as illustrated in FIG. 4, is a hoop stress, and this means that the body can be of lighter construction, than would be the case with a column type machine, required to withstand the same operational loads. It is also a significant feature of the construction, that the weld 12 between the ends of the member forming the body, is vertically aligned with the line of action of the operational force, i.e. it is on the X—X axis. In this position, the weld itself is subjected to minimal opening action, and this is clearly desirable.

Figure 3:
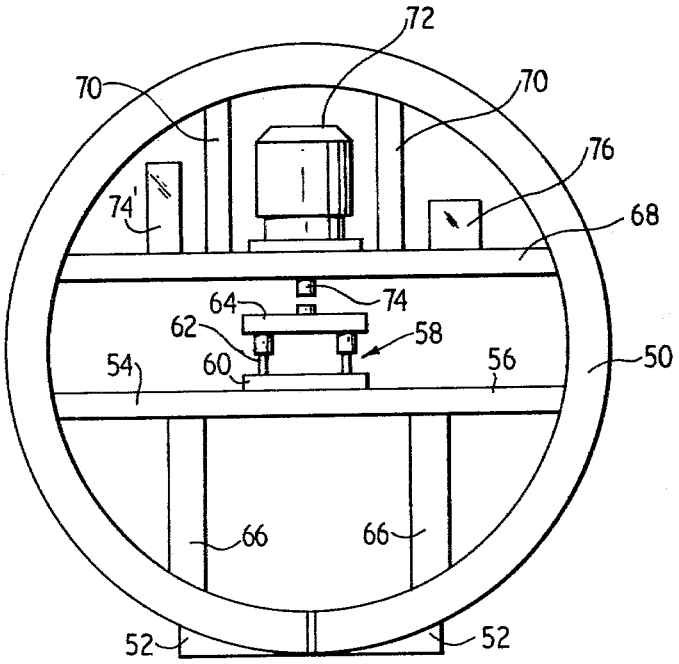
FIG. 3 is an end view of a press tool.

Turning now to the machine which is illustrated in FIG. 3, this is a fly press, designed to operate at higher working loads than the simple machine illustrated in FIGS. 1 and 2. Again, there is a machine body 50 constructed in similar fashion to the body 10, and provided with feet 52, whereby it is adapted to stand in an upright position.

A first horizontal beam 54 made in this instance from rolled hollow section steel, is welded across a chord of the circular body 50, a little below the horizontal diameter of the body. The horizontal top surface 56 of the beam 54 provides a platen, on which can be placed a press tool die set of conventional construction, such as that illustrated at 58. There is no need to describe the die set in detail, but it will simply be mentioned, that it has a base 60, a pair of upright columns 62, and a top member 64, which is movable vertically on the columns 62.

Beneath the beam 54, there is a pair of vertical struts 66 which in this instance are formed of channel-shaped rolled steel, and these struts may be welded at their lower ends to the inside of the hoop body 10, and at their upper ends to the underside of the horizontal beam 54. This construction ensures that the beam 54 is held quite rigid against downwardly applied loads, and indeed the beam 54 and its vertical support struts 66, can be regarded as an integral part of the machine body.

A second horizontal support beam 68, also made of rolled hollow steel section, is fixed across the inside of the body 50, parallel with but spaced vertically above the first horizontal beam 54, and hence the beam 68 also occupies a chord of the circular body. At its ends, the beam 68 may be welded to the inside of the body 50, and there are vertical struts 70 extending between the top part of the body 50 and the top side of the support beam 68, these struts being secured at their ends to the body 50 and the support beam. In this way, another rigid assembly is provided within the circular body 50, whereby the beam 68 is well adapted to resist vertically applied loads.

It will be appreciated, that the arrangement of the two beams 54 and 68 with their respective struts 66 and 70 within the hoop 50 adds considerably to the rigidity of the hoop itself.

A pneumatic or hydraulic ram-and-cylinder device 72 is secured to the top of the beam 68, the arrangement being such that the ram 74 is vertically aligned with the centre of the movable member 64 of the die set 58. As with the arrangement illustrated in FIGS. 1 and 2, the vertical axis of the ram-and-cylinder 72, is on a vertical diameter of the body 50 (the X—X axis).

The support beam 68 also carries a valve 74', and a manually adjustable control valve 76, these being both arranged in the control circuit for the ram-and-cylinder device 72.

When the press is to be used, the workpiece is placed on the die set in the conventional manner, and then the machine is operated to project the ram 74 into engagement with the movable member 64 of the die set. In this way, the die set is caused to carry out a working stroke on the workpiece. The stress set up in the body 50, is similar to that described with reference to FIGS. 1, 2 and 4, although in this construction, the body is even better adapted to deal with this stress, because of the provision of the beams 54 and 68, and the struts 66 and 70. In fact, the construction illustrated in FIG. 3 represents almost the opposite end of the design spectrum, to that illustrated in FIG. 1. In FIG. 1, the machine body is constituted entirely by the hoop 10, whereas in FIG. 3, the machine body includes a very rigid internal framework, in addition to the hoop 50. It will be readily appreciated, that various other internal strengthening arrangements could be used within the hoop body 10 or 50.

Figure 5:
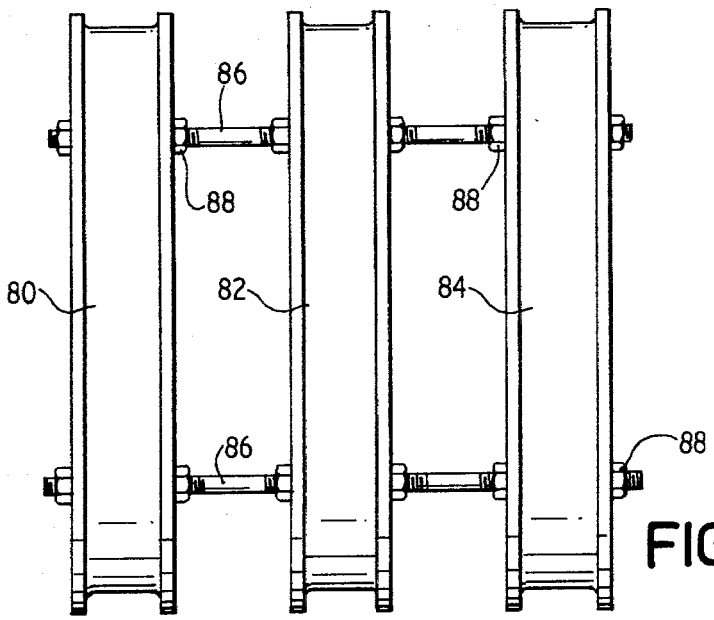
FIG. 5 is a side view of an extended width machine.

FIG. 5 illustrates a machine which is required to withstand greater operating forces than the machine illustrated in FIG. 1, or which is required to carry out a series of operations simultaneously, or to carry a larger platen. The body of the machine comprises three hoops 80, 82 and 84, each of which is made from a channel section, and the general construction of each of these hoops is as previously described. However, in this arrangement, the three hoops are connected by a series of horizontal struts 86, at spaced apart positions around the hoops. Each strut 86 is screw-threaded, and nuts 88 are applied to the struts, so as to clamp the hoop bodies 80, 82 and 84, and to hold these bodies in a rigid spaced apart arrangement.

As a result of this construction, the overall thickness of the machine from end to end, is equal to the combined thicknesses of the three hoop bodies 80, 82 and 84, plus the lengths of the struts 86, where they extend between the hoops. It will be appreciated, that any number of hoop bodies can be connected together in this manner, in order to provide a machine of a required length.

In some instances, where more than one hoop is required, these bodies may be simply arranged in face-to-face relationship, and secured together by bolting clamping or welding, to produce the required body thickness.

In both the examples described with references to FIGS. 1 to 3, besides the hoop which provides the body of the machine and takes the operating stresses, there is a stationary element (the die 24 or the base 60) and a movable element (the ram 36 or the top member 64) but it should be understood that in some applications of the invention, there could be two opposed movable elements (e.g. two rams adapted to move towards each other). It should further be understood that for other applications there may be three or more operative elements. For example in a press, there could be two elements facing in one direction and a single element facing in the opposite direction. In such an arrangement it would be preferable to arrange the operative elements so that the forces are balanced as far as possible on each side of a diameter of the hoop body. Sometimes however it may not be possible to achieve this but in any event the arrangement of the operative elements will be such that the reaction to the operative force (or the vector addition of the operative forces) acts along a diameter or a line parallel with a diameter (i.e. a chord) of the hoop body.

Figure 6:
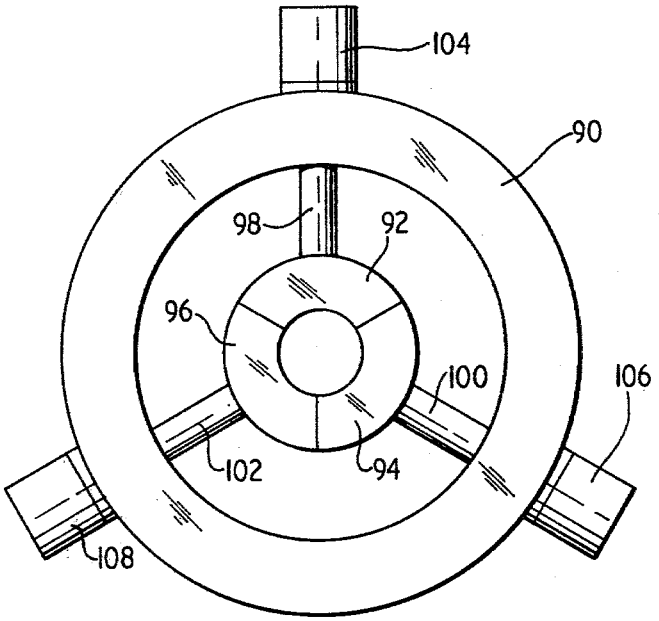
FIG. 6 is an end view of a die-casting machine.

In some instances it may be possible to arrange for a balanced application of the operating forces, and one construction in which this is achieved is shown in FIG. 6, which is a pressure die-casting machine having a body 90 in the form of a hoop and a set of three dies 92, 94 and 96 which in their closed position as illustrated, meet at the centre of the hoop body. Each of the dies is carried by a respective ram 98, 100, 102 which projects radially inwardly from a hydraulic cylinder 104, 106 or 108. The cylinders are, in this instance, mounted on the outside of the hoop 90 and this exemplifies the fact that the devices which provide the operating face(s) need not themselves be located in the hoop.

When the rams retract, the dies 92, 94 and 96 open radially outwards, but when the rams are again projected all three dies are pressed together. The reaction forces to the pressure applied by the cylinders 104, 106 and 108 via their respective rams will be applied to the hoop as three radially outward forces. These reaction forces will thus attempt to distend the hoop 90 at three positions, but this still produces hoop stress in the body 90.

It is to be understood, that one of the dies 92, 94 and 96 could be located in a fixed position, and the other two dies moved by rams towards it. Alternatively, two of the dies could be stationary and the other die moved towards them.

It is also to be understood that more than three dies (or other operative members) could be mounted for operative movement in the body. In fact, in one instance there could be a plurality of drills all being fed inwardly (radially or chordally) towards a workpiece or component.

It will be appreciated, that various modifications are possible, without departing from the scope of the invention. For example, the operating force may be derived from something other than a pneumatic or hydraulic ram-and-cylinder device as illustrated in FIGS. 1, 3 and 6. In a very simple form of press, there may be a hoop body of the type described above, with a platen in the lower part, and an externally screw-threaded operating rod, engaging in an internally screw-threaded block secured to the zenith of the hoop. Thus, by rotating the rod, it can be moved towards and away from the platen in order to perform a working operation. Such a screw-threaded rod, may be equipped with a wheel or handle, for manual operation, or it may be connected to a prime mover such as a geared motor.

Also, it will be appreciated that it is possible to provide various mechanisms for increasing the mechanical advantage between the operating member, and the movable element of the machine. For example, a toggle mechanism could be connected between a lug mounted at the zenith of the hoop body, and an operating member constrained for vertical motion towards and away from the platen. The toggle link could be attached to a member movable horizontally, in order to expand or contract the toggle, the horizontally movable member, being itself capable of manual or power operation. Again, the prime mover of the machine could be adapted to operate a crank mechanism, for carrying out the working stroke of the machine.

Because a machine such as a press constructed in accordance with the invention is of relatively small overall thickness, it is possible to arrange a plurality of such machines in close juxtaposition to each other, so that a succession of operations can be carried out on a single workpiece, such as a strip of material being progressed through the arrangement of machines in step-wise fashion. The machine constructed as shown in FIG. 5 is adapted to this step-wise progression if the spacing of the operating members in the hoops 80, 82 and 84 is equal to the spacing between the required operations on the strip of material.

Figure 7:
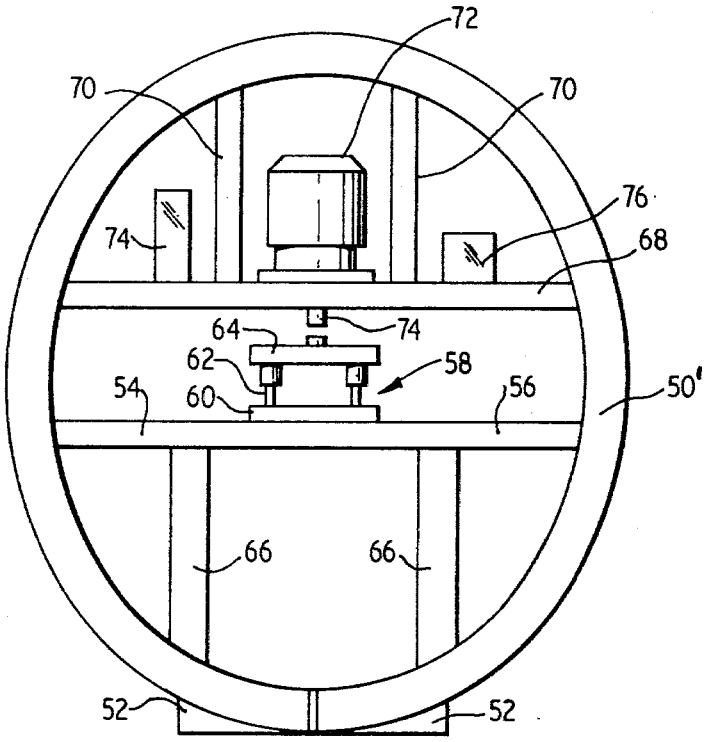
FIG. 7 is an end view similar to FIG. 3 of another embodiment of a press tool.

Whilst in the above described exemplary constructions, the body 10, 50, 80, 82, 84 or 90 is made in the form of a circular hoop, it is to be understood, that the body could also be made in elliptical form as shown in FIG. 7, wherein like parts are given the same reference numerals as in FIG. 1, but the body 50' has an elliptical shape. In that case, the body could be arranged, so that the operating force is on either the major, as shown in FIG. 7, or the minor axis of the body.

I claim:

1. A press action machine comprising:

(a) a body comprising at least one annular member and at least one reinforcing beam extending chordally of said annular member and from side-to-side thereof;

(b) at least one operative element adapted for simple linear reciprocatory motion along a path;

(c) said operative element being mounted in a position in relation to said body such that said path of said linear reciprocatory motion of said operative element is substantially parallel with a diameter of said annular member and transverse to said reinforcing chordal beam; and (d) at least one means for coacting with said operative element;

(e) said coacting means being mounted in a position in relation to said body in line with said path of said operative element;

(f) whereby, when said operative element moves toward and coacts with said coacting element resulting in a force being applied in opposite directions along said path to said annular member, said reinforcing chordal beam directly resists compression of said annular member in a direction perpendicular to said path of said operative element and thereby indirectly resists elongation said annular member in the direction of said path.

2. A press action machine according to claim 1 wherein said annular member is substantially circular.

3. A press action machine according to claim 1 wherein said annular member is substantially eliptical.

4. A press action machine according to claim 1 wherein said body comprises a plurality of said annular members arranged concentrically.

5. A press action machine according to claim 1 wherein said operative element is positioned in relation to said body such that said path of said linear reciprocatory motion of said operative element is perpendicular to said reinforcing chordal beam.

6. A press action machine according to claim 1 wherein said body comprises two of said reinforcing chordal beams spaced from each other and extending chordally of said annular member and from side-to-side thereof, said operative element being mounted on one of said reinforcing chordal beams and said coacting means being mounted means on the other of said reinforcing chordal beams.

7. A press action machine according to claim 1 wherein said at least one coacting means comprises at least one means for supporting at least one workpiece, said coacting means being positioned in relation to said annular body such that said workpiece is supported in line with said path of said operative element and said operative element may be pressed against said workpiece.

8. A press action machine according to claim 1 wherein said coacting means comprises an anvil and said operative element comprises a tool carrier adapted to cooperate with said anvil, said machine further comprising power means for reciprocating said tool carrier, said power means being supported by said beam.

9. A press action machine according to claim 1 wherein said body comprises at least one further reinforcing strut extending transversely of said reinforcing chordal beam from said chordal beam to said annular member.

10. A press action machine according to claim 9 wherein said reinforcing chordal beam and reinforcing strut are perpendicular to each other.

11. A press action machine comprising:

(a) a body comprising an annular composite member comprising a plurality of annular members with means securing said annular members together end-to-end and at least one reinforcing beam extending chordally of at least one of said annular members and from side-to-side thereof;

(b) at least one operative element adapted for simple linear reciprocatory motion along a path;

(c) said operative element being mounted in a position within said annular composite member such that said path of said linear reciprocatory motion of said operative element is substantially parallel with a diameter of said annular composite member and transverse to said reinforcing chordal beam; and (d) at least one means for coacting with said operative element;

(e) said coacting means being mounted in a position within said annular composite member such that said coacting means is in line with said path of said operative element;

(f) whereby, when said operative element moves toward and coacts with said coacting element resulting in a force being applied in opposite directions along said path to said annular composite member, said reinforcing chordal beam directly resists compression of said annular composite member in a direction perpendicular to said path of said operative element and thereby indirectly resists elongation of said annular composite member in the direction of said path.

12. A press action machine according to claim 11 wherein said operative element is positioned in relation to said annular composite member such that said path of said linear reciprocatory motion of said operative element is perpendicular to said reinforcing chordal beam.

* * * * *